United States Patent [19]

Matsui et al.

[11] Patent Number: 4,681,271

[45] Date of Patent: Jul. 21, 1987

[54] YARN END FINDING APPARATUS

[75] Inventors: Isamu Matsui, Kyoto; Hiroshi Uchida, Oumihachiman; Hiroo Otoshima, Shiga; Yasuhiko Kubota; Tetsuji Masai, both of Nagaokakyo, all of Japan

[73] Assignee: Murata Kikai Kabushiki Kaisha, Kyoto, Japan

[21] Appl. No.: 821,698

[22] Filed: Jan. 23, 1986

[30] Foreign Application Priority Data

Jan. 23, 1985 [JP] Japan ..... 60-10565

[51] Int. Cl.[4] ..... B65H 54/00

[52] U.S. Cl. ..... 242/18 R; 242/35.5 R; 242/35.6 R

[58] Field of Search ..... 242/18 R, 18 EW, 35.5 R, 242/35.5 A, 35.6 R, 35.6 E

[56] References Cited

U.S. PATENT DOCUMENTS

| | | | |
|---|---|---|---|
| 2,675,971 | 4/1954 | Abbott | 242/35.6 R |
| 3,224,694 | 12/1965 | Oishi | 242/35.5 R |
| 3,279,712 | 10/1966 | Furst | 242/35.5 R |
| 3,295,775 | 1/1967 | Raasch et al. | 242/35.5 R |
| 3,544,018 | 12/1970 | Stoppard et al. | 242/35.6 R |
| 3,563,478 | 2/1971 | Bell | 242/35.6 R |
| 3,727,852 | 4/1973 | Nelson et al. | 242/35.6 R |
| 3,747,862 | 7/1973 | Raasch | 242/35.6 R |
| 4,544,107 | 10/1985 | Matsui et al. | 242/35.5 A |

*Primary Examiner*—Stanley N. Gilreath

*Attorney, Agent, or Firm*—Spensley Horn Jubas & Lubitz; 38

[57] ABSTRACT

An apparatus for finding an end of a yarn of a spinning bobbin comprising a cutter mechanism located adjacent a path along which a spinning bobbin fitted uprightly on a tray is fed for releasing and cutting a bunch of a yarn on the bobbin, a yarn end pick-up mechanism located next to the cutter mechanism for picking up an end of the out yarn from a layer of the yarn, and a yarn end inserting mechanism located next to the yarn end pick-up mechanism for cutting the yarn end picked up frm the yarn layer into a string of a particular length and for inserting the yarn into a center hole of the bobbin.

17 Claims, 22 Drawing Figures

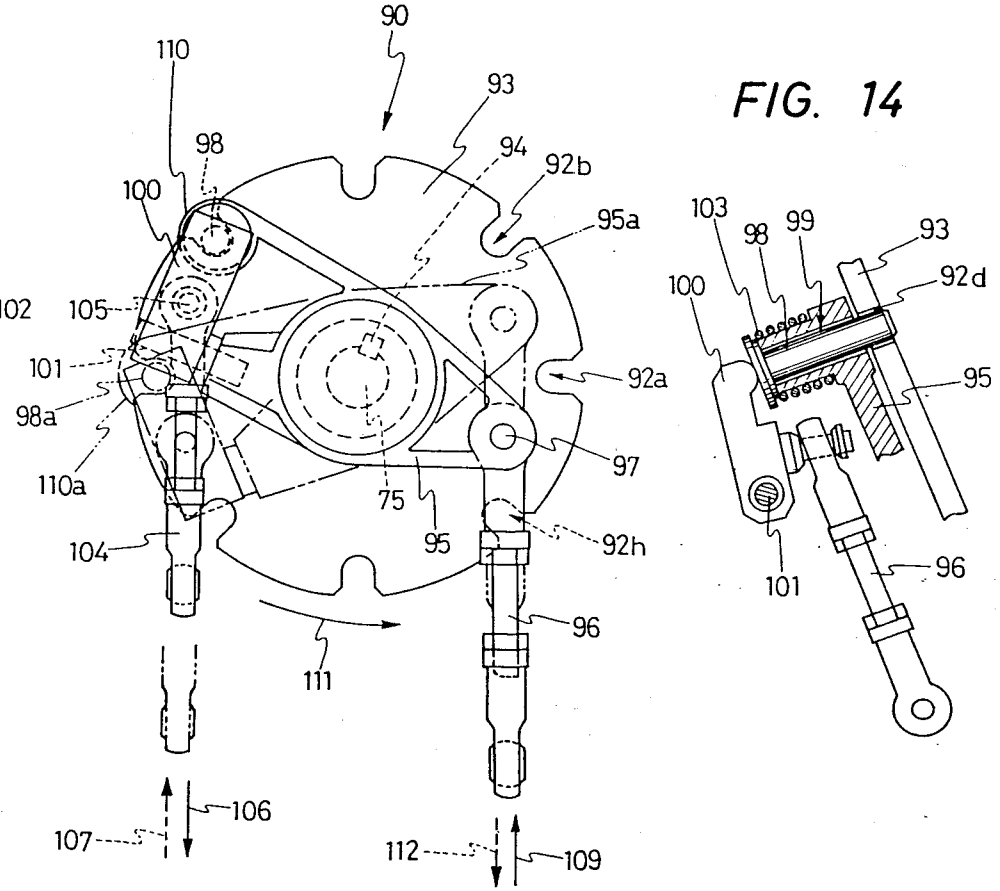
FIG. 13
FIG. 14
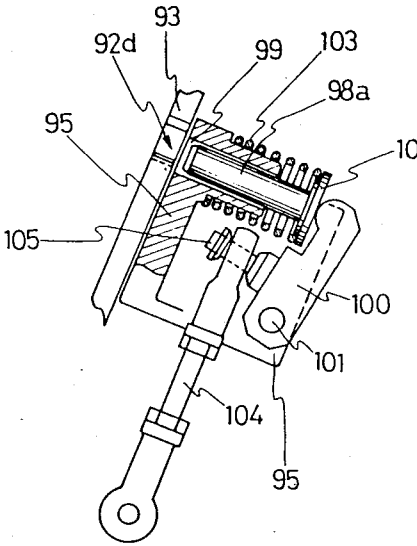
FIG. 15

YARN END FINDING APPARATUS

FIELD OF THE INVENTION AND RELATED ART STATEMENT

This invention relates to a yarn end finding apparatus for a spinning bobbin.

In a spinning bobbin produced on a spinning frame, particularly on a ring spinning frame, before it is transported to a subsequent next rewinding step, an end of a yarn is wound in several turns around a portion thereof upon ending of winding thereof in order to prevent the end of the yarn from being released from the spinning bobbin or from being twisted with an end of another yarn on another spinning bobbin. When such a spinning bobbin is to be supplied to an automatic winder for a rewinding step, such winds of the yarn must have been released, and to this end, a yarn end finding apparatus is arranged near the automatic winder.

Meanwhile, the present applicant has formerly proposed as a transporting device for spinning bobbins a device which transports bobbins while they are fitted uprightly on independent bobbin transporting media (hereinafter referred to as a bobbin tray or trays). In finding an end of a yarn on a spinning bobbin which is fitted uprightly on such a bobbin tray, the bobbin is gripped by a chuck member for moving a bobbin up and down, and then after the bobbin is pulled off the tray, the yarn end is processed. This, however, results in limitation in the speed of the yarn end finding process, which is 20 bobbins per minute or so to the utmost. Besides, where there exist at the same time various types of bobbins which may be different in length of bobbins themselves, thickness of take-up tubes and so on, such an inconvenience will be caused that it is necessary to change a stroke of up and down movement for a bobbin chuck or to modify or change chucking parts, and hence such an arrangement is not suitable for processing of different types of bobbins.

OBJECT AND SUMMARY OF THE INVENTION

It is an object of the invention to provide a yarn end finding apparatus which can deal with a plurality of types of bobbins and can allow high speed processing of them.

According to the present invention, a bobbin can undergo a yarn end finding operation while it is held fitted uprightly on a tray without being pulled off the tray.

An apparatus of the present invention comprises a cutter mechanism located adjacent a path along which a bobbin fitted uprightly on a tray is fed for releasing and cutting a bunch of winds of a yarn on a bobbin which passes by the cutter mechanism, a yarn end finding mechanism located next to the cutter mechanism along the path for releasing an end of the yarn from the bobbin, and a yarn end inserting mechanism located next to the yarn end finding mechanism for inserting the picked up yarn into a winding pipe from a head portion of the bobbin.

A spinning bobbin is intermittently fed while it is held fitted uprightly on a transportation tray, and during such feeding, releasing of a bunch of winds, finding of an end of a yarn, and insertion of an end portion of the yarn of a fixed length into a center hole of the bobbin are effected in order while the bobbin is thus held integrally on the tray, whereafter the bobbin is supplied to a winder.

BRIEF DESCRIPTION OF THE DRAWINGS

FIG. 13 a plan view showing a drive mechanism for the rotary plate of FIG. 11;

FIG. 14 a side elevational view, partly in section, showing a feed plate 93 engaged with a pin 98 of the drive mechanism of FIG. 13;

FIG. 15 a side elevational view, partly in section, showing the feed plate disengaged from the pin of the drive mechanism of FIG. 13;

DETAILED DESCRIPTION OF PREFERRED EMBODIMENTS

Now, an embodiment of the present invention will be described with reference to the drawings.

It is to be noted that while the embodiment is shown which is applied for a spinning bobbin which has a bottom-bunch provided at a lower end portion thereof, it can be applied also for a bobbin having a top bunch thereon but with some modification.

Figure 1:
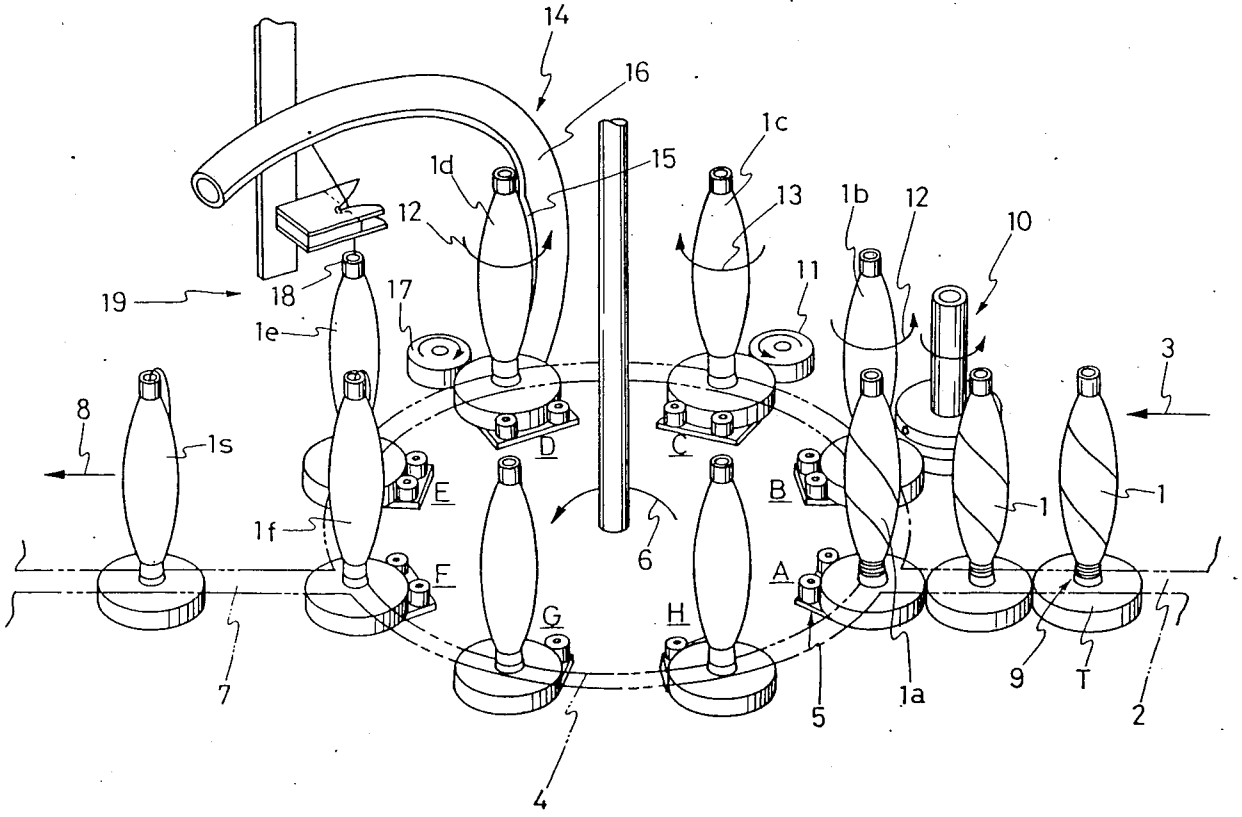
FIG. 1 is a perspective view illustrating general construction of an embodiment of an apparatus according to the present invention.

Referring to FIG. 1, a general construction of a yarn end finding apparatus is shown. A bobbin 1 from a spinning frame is fed in a direction of an arrow mark 3 along a transportation path 2 to an admitting position A of the yarn end finding apparatus while it is held uprightly fitted on a tray T. Thus, the bobbin 1 is admitted into the yard end finding apparatus by one of tray receiving members 5 which are secured in a spaced relationship by a fixed distance to a rotary plate 4 of the yarn end finding apparatus. The admitted bobbin indicated at 1*a* then passes several stations B, C, D and E and comes to a discharging station F by intermittent rotations of the rotary plate 4 in a direction of an arrow mark 6. At the station F, a bobbin from which an end of a yarn has been successfully picked up, such as a bobbin 1S, is introduced into a transportation path 7 along which it will be transported in a direction of an arrow mark 8 to a winder.

At station B a cutter device 10 for releasing and cutting a bottom-bunch 9 wound at a lower end portion of a bobbin is provided. At station C a roller 11 is provided for picking up a yarn extending between a bobbin 1*c* and the cutter 10 and for lightly winding it on a surface of a layer of the yarn. At station B a bobbin 1*b* is rotated by a friction roller in a direction 12 to release a yarn wound thereon. At station C a bobbin 1*c* is rotated in a direction 13 to wind a yarn therearound by the roller 11. Further, at the station D, a yarn end sucking and releasing device 14 for sucking and releasing an end of a yarn in a free condition is provided, which may be constituted, for example, from a suction mouth 16 having a slit 15. At the station D, a bobbin 1*d* is rotated in the direction 12 to release the yarn therefrom by a friction roller 17. Further, at the station E, a yarn end inserting mechanism 19 is located for cutting a yarn picked up from a bobbin into a yarn end of a fixed length and for inserting the end of the yarn into a center hole 18 of the bobbin 1*e*.

It is to be mentioned here that a bobbin tray T in the present embodiment includes a base member 20 in the form of a disk and a stand 21 and a bobbin receiving peg 22 integrally formed on the base member 20 and has a hollow 23 formed therein which is open at the bottom thereof. An air passing hole 24 is perforated in the peg 22. Accordingly, if a sucking air flow in a direction of an arrow mark 25 is caused to act into the inside of the tray T, then a sucking force 26 will act within the bobbin center hole 18 via the air passing hole 24.

Figure 2:
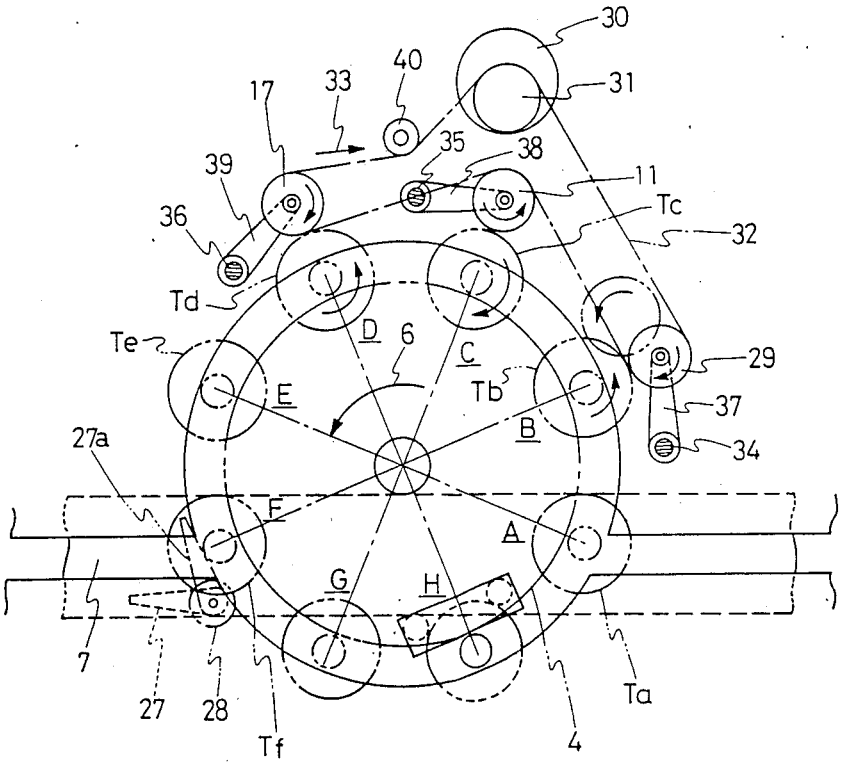
FIG. 2 a plan view showing a layout of the apparatus of FIG. 1.

FIG. 2 is a plan view of the bobbin processing stations. When a tray Ta which has a bobbin fitted uprightly thereon comes to the discharging position F by intermittent rotations of the rotary plate 4 each time by an angle of 45 degrees in the direction of the arrow mark 6 after it has come to the admitting position A and passed the processing stations B to E, if an end of a yarn has been already picked up therefrom, then it is discharged into the transporting path 7, but on the contrary if an end of a yarn has not successfully been picked up therefrom, it is hindered by a movable guide 27 and is thus introduced again to the finding processing admitting position A via by-passes G and H in order to repeat the same operations. In particular, a sensor for detecting a picked up yarn end is provided in the station E, and if the sensor detects that there is no yarn on a bobbin, the movable guide 27 of FIG. 2 is moved to a position 27*a* by means of a rotary solenoid 28 or the like to prevent discharging of the tray Tf which has arrived at the position F.

It is to be noted that FIG. 2 shows friction rollers 29, 11 and 17 and a drive source 30 for rotating bobbins in the processing stations B, C and D, respectively. An endless belt 32 extends over an output pulley 31 of the motor 30 and the rollers 29, 11 and 17 so that circulation of the belt 32 in a direction of an arrow mark 33 will rotate the rollers 29, 11 and 17 in respective predetermined directions. In this instance, the rollers 29 and 17 rotate trays Tb and Td contacted therewith in a direction to release a yarn from a bobbin thereon while the roller 11 rotates a tray Tc in a direction to wind a yarn. The rollers 29, 11 and 17 are supported for rotation on levers 37, 38 and 39 which are mounted for rocking motion around fixed shafts 34, 35 and 36, respectively. Accordingly, due to a tensile force of the belt 32, the levers 37, 38 and 39 on which the rollers 29, 11 and 17 are mounted are acted upon by urging forces in directions to contact the rollers 29, 11 and 17 thereon with circumferential faces of the base members 20 of the trays with a sufficient frictional force. Reference numeral 40 denotes a tension pulley.

Now, processing mechanisms provided in the individual processing stations will be described.

Figure 4:
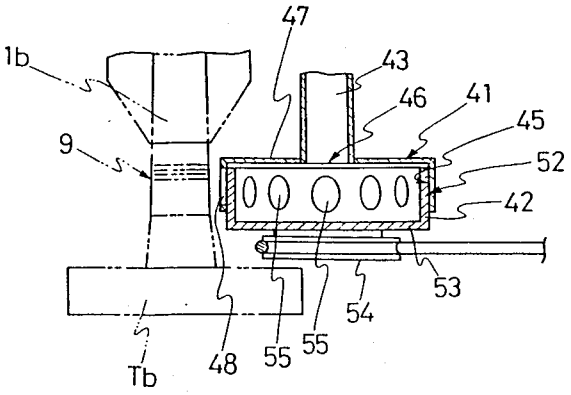
FIG. 4 a front elevational view, partly in section, of the cutter device of FIG. 3.
Figure 3:
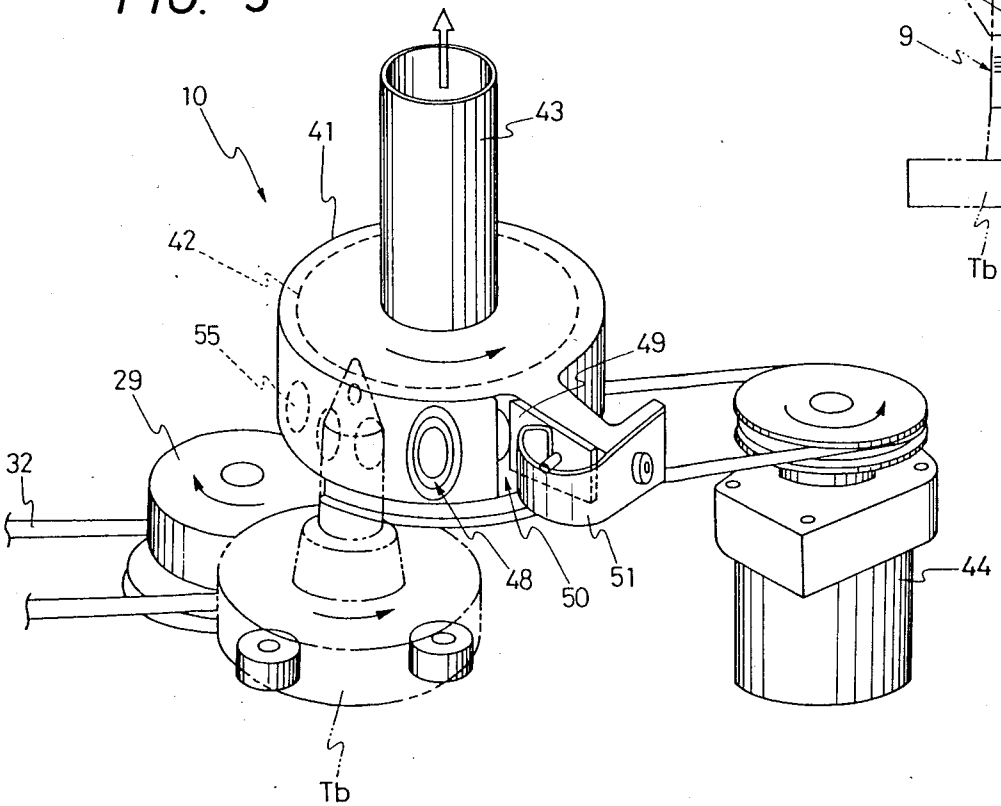
FIG. 3 a perspective view illustrating general construction of a cutter device.
Figure 5:
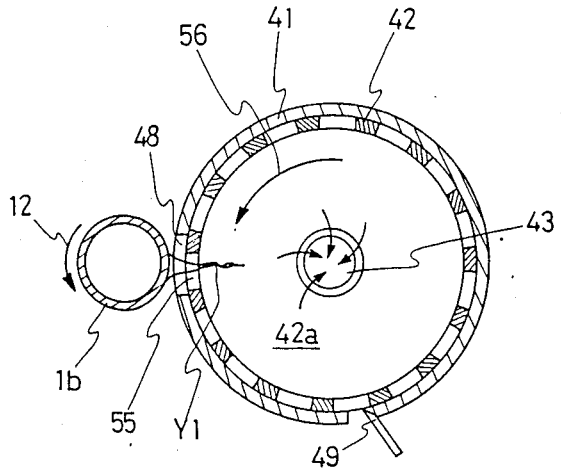
FIG. 5 a sectional plan view illustrating an initial condition of a process of releasing a bunch of winds on a bobbin by the cutter device of FIG. 3.

FIGS. 3 to 5 illustrate the cutter device 10 provided in the processing station B for releasing and cutting a bottom-bunch. The cutter device 10 includes a suction case 41 fixedly supported on a fixed frame, and a rotary cutter 42 mounted for rotation within the suction case 41. A suction pipe 43 for producing a suction air flow within an inside spacing of the rotary cutter 42 is connected to the suction case 41 while a motor 44 for driving the rotary cutter 10 is located adjacent the cutter device 10. The friction roller 29 is further provided for rotating a bobbin in a yarn releasing direction.

The suction case 41 has an inner circumferential face 45 having a substantially same diameter with an outer circumferential face of the drum-shaped rotary cutter 42, and a top wall face 47 having a suction air flow passing hole 46 formed therein. At a portion of the outer circumferential face of the case 41, a yarn end sucking opening 48 and a slot 50 for permitting an edge of a fixed blade 49 to contact with the outer circumferential face of the rotary cutter 42 are formed in a spaced relationship. A spring plate 51 is provided for pressing the fixed blade 49 against a support face of the case 41.

Meanwhile, the rotary cutter 42 accommodated in the suction case 41 is in the form of a drum having an outer circumferential wall face 52 and a bottom wall face 53, and includes a pulley 54 integrally secured thereto. The rotary cutter 42 has a plurality of yarn end passing holes 55 formed in an equidistantly spaced relationship in the outer circumferential wall face 52 thereof. The holes 55 are preferably circular, and a cutter is formed by a circumferential edge of each hole 55 and the fixed blade 49.

The suction case 41 is securely installed at such a position that the yarn end sucking opening 48 of the suction case 41 may moved from a side to the bottom-bunch 9 of a bobbin 1*b* which has come to the station B, as shown in FIG. 4. Thus, since in the present embodiment the bottom-bunch is at a lower portion of a bobbin, the suction case 41 is secured at a corresponding position. But otherwise where a bobbin having a top bunch wherein a bottom-bunch are at an upper part of the bobbin, the suction case is naturally installed at a position corresponding to the position of the top bunch winds.

Figure 6:
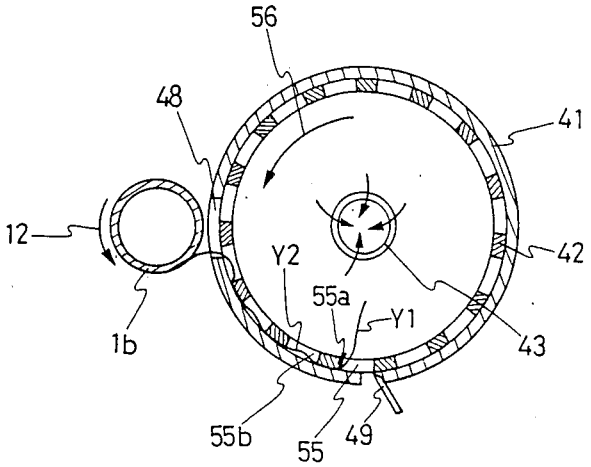
FIG. 6 a sectional plan view illustrating a condition of a yarn picked up just before it is cut.

Accordingly, if the rotary cutter 42 is rotated in a direction of an arrow mark 56 and suction air flows are produced within the drum 42 as shown in FIGS. 5 and 6, an end of a yarn wound on a lower end portion of a bobbin 1*b* or a yarn Y1 twisted with a yarn portion adjacent the beginning end of the wound yarn will be sucked into the inside 42*a* of the drum 42 through the opening 48 of the suction case 41 and a hole 55 in the circumferential face of the drum 42 due to a sucking action of the drum 42 and thus the yarn end will be released by rotation of the drum 42 and also by rotation of the bobbin 1*b* in the direction of the arrow mark 12, that is, in a direction opposite to the winding direction of the yarn on the bobbin 1b. Once the yarn end Y1 is sucked into the inside of the drum 42, the yarn drawn from the bobbin is attracted to the circumferential face of the drum 42 and is thus fed through a gap between the casing 41 and the drum 42 so that it is released forcibly from the bobbin 1*b*.

The yarn Y1 thus fed is cut by a rear edge 55*a* of a hole 55 and the fixed blade 49 as the hole 55 of the drum 42 through which the yarn has been sucked passes the position of the fixed blade 49. A yarn string thus cut off is sucked or discharged into the suction pipe 43. As the drum 42 is rotated further, a yarn Y2 introduced through a following next hole 55*b* will be cut in a similar manner.

It is to be noted that, in order to apply the gap between the opening 48 of the suction case 41 and a bunch wind portion of a bobbin to a bobbin of a different type having a different diameter, the entire cutter mechanism may be placed on a movable bracket which is moved in response to a type of a bobbin. By this arrangement, a plurality of types of articles can be handled.

Referring now to FIGS. 7 to 10, a device for introducing a picked up end of a yarn to a predetermined position of a bobbin will be described. In the present embodiment, a type of a bobbin wherein a released end of a yarn is fed while it is inserted in the center hole 18 of the bobbin from above is illustrated.

In particular, the yarn end inserting device is provided to extend between the processing stations D and E. The yarn end inserting device includes the suction mouth 16 provided in the station D, a cutter 60 provided in the station E for detecting the presence or absence of a yarn picked up from a bobbin and for cutting the yarn at a position of a predetermined length from the extremity of the yarn, a yarn end sucking mechanism 61 for sucking the thus cut yarn end into the center hole 18 of a bobbin, and so on.

The suction mouth 16 is constituted from a substantially L-shaped suction pipe 63 which has an opening 15 in the form of a slit extending along the length of a layer of a yarn on a bobbin 1*d* in the station D, and a slit 62 formed contiguously to the opening 15 and extending to a position above the yarn detecting and cutter device 60 in the station E. The pipe 63 is connected to a suction blower not shown.

In the station E, a pair of guide plates 64 for guiding a yarn Y3 extending between a bobbin 1*e* at the station E and the slit 62 of the suction mouth 16 to the yarn detecting and cutter device 60 are mounted on a fixed support member 65 in an integral relationship with the cutter device 60 and is located above the bobbin 1*e* at the station E. Also, a guide member 67 for guiding and positioning a head portion 66 of a bobbin to a fixed is to be noted that while the cutter device 60 is of a type which involves a yarn detecting function and a cutter function such as a slub catcher with a cutter which is used in a winder, naturally an arrangement which includes therein yarn detecting means and a separate cutter is also applicable.

The suction mouth 16 has an auxiliary air path 69 formed in a curved portion 68 thereof between the opening 15 positioned adjacent a layer of a yarn on a bobbin and the slit 62 which guides a sucked yarn to the cutter device. The auxiliary air path 69 is provided to feed a sucked yarn assuredly from the opening 15 to the slit 62 above. The path 69 has an air injecting hole 70 formed therein for injecting compressed air toward a yarn feeding direction, and compressed air is supplied to the air injecting hole 70 by way of a pipe which connects to a compressed air supply source not shown.

Figure 7:
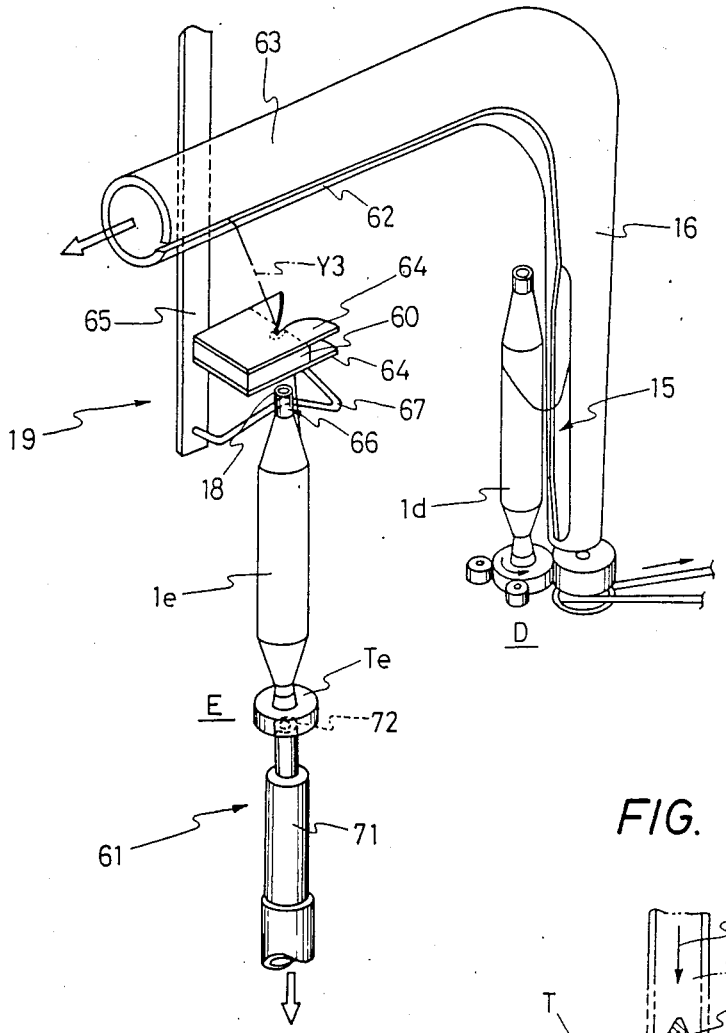
FIG. 7 a perspective view illustrating general construction of processing devices in processing stations D and E.
Figure 8:
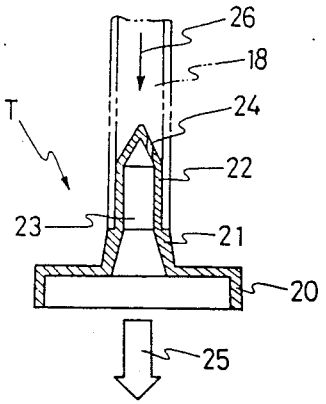
FIG. 8 a cross sectional front elevational view illustrating a structure of a tray which is applied to the present embodiment.
Figure 9:
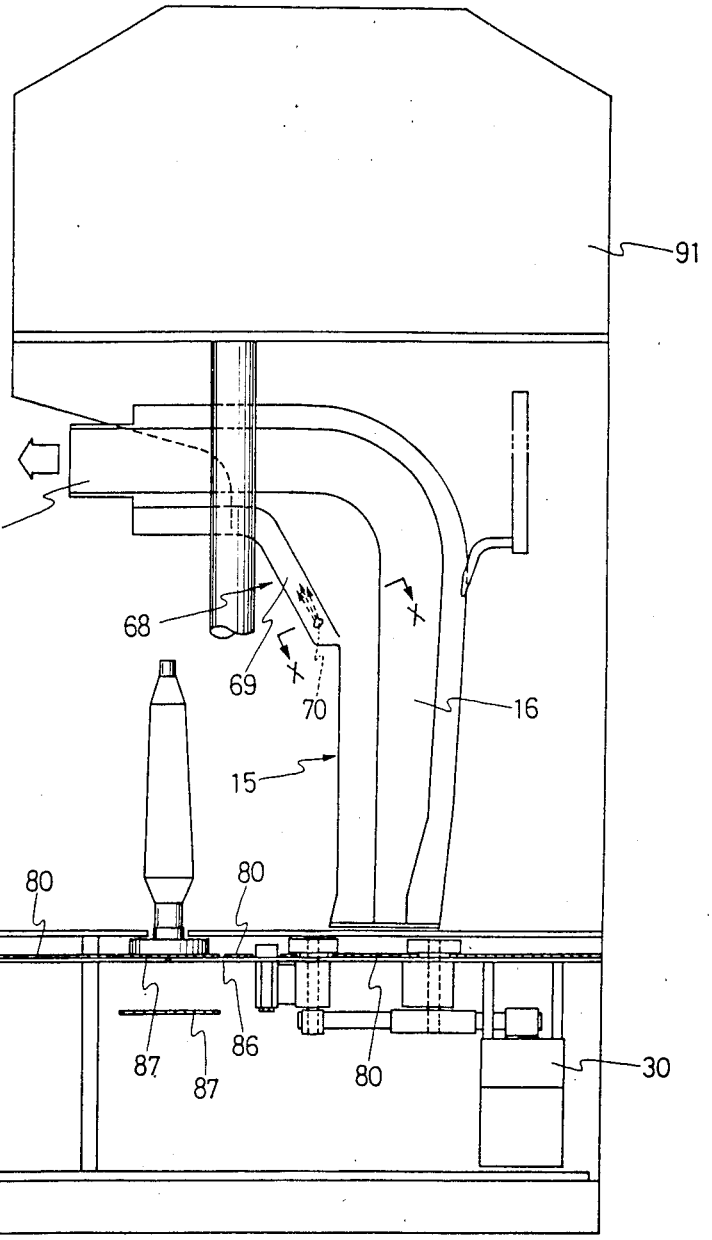
FIG. 9 a side elevational view illustrating an arrangement and construction of a suction mouth.
Figure 10:
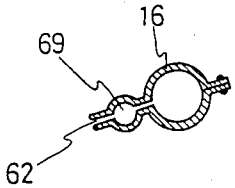
FIG. 10 a sectional view taken along line X—X of FIG. 9.

Referring to FIG. 7, located just below a tray in position in the station E is in an opening 72 of a suction pipe 71 for causing a suction air flow to act in the center hole of a bobbin 1*e*. Accordingly, if a bobbin 1*e* comes to the station E and a yarn picked up from the bobbin 1*b* is cut above the bobbin center hole, a yarn end thus cut and connecting to a yarn layer will be sucked into the center hole by a sucking force acting in the center hole, thereby completing a cycle of yarn end finding operation.

Now, the rotary member and a drive therefor which constitute the processing stations A to F will be described.

Figure 11:
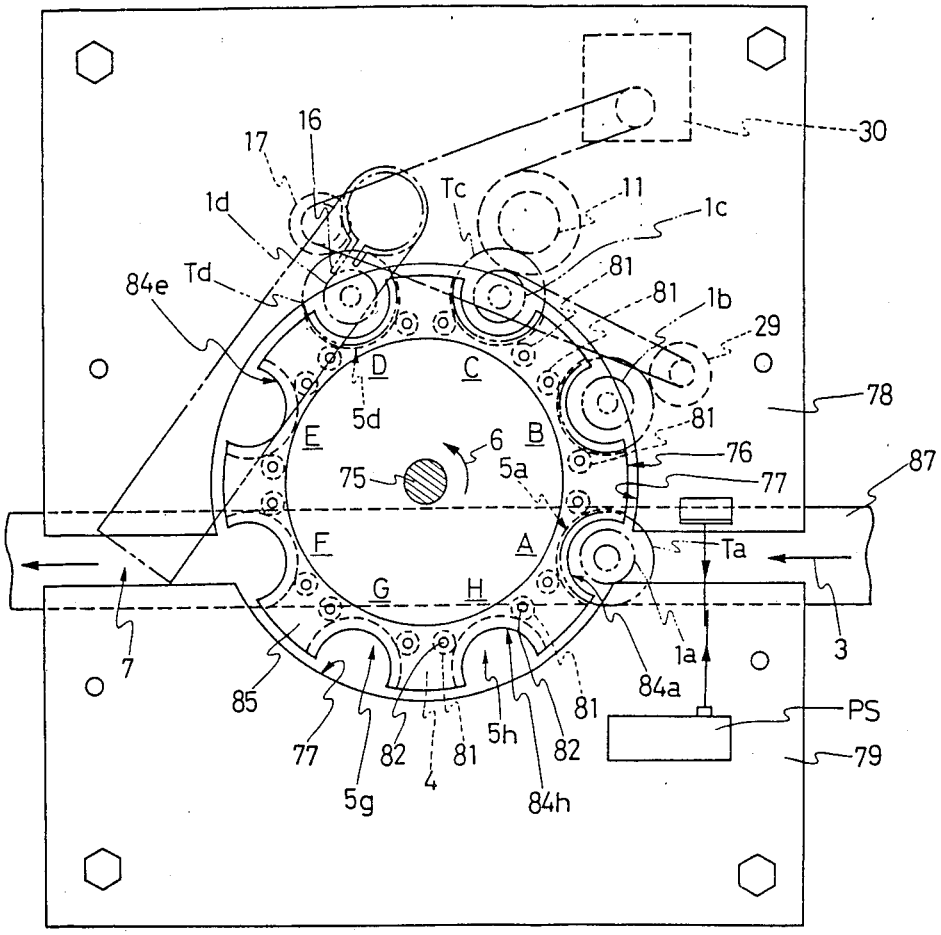
FIG. 11 a plan view illustrating an embodiment of a rotary plate for feeding a tray.
Figure 12:
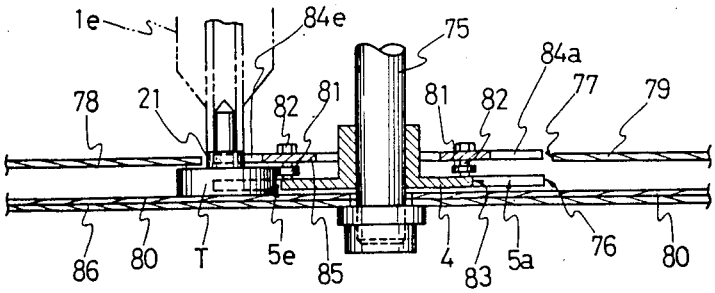
FIG. 12 a sectional side elevational view of the rotary plate of FIG. 11.

Referring to FIGS. 11 and 12, the rotary plate 4 is secured to a vertically extending shaft 75 and has tray receiving grooves 5*a* to 5*h* formed in a predetermined pitch along a periphery thereof. A pair of outer guide plates 78 and 79 are secured to the body frame and have a guide face 77 concentrical with and spaced apart from an imaginary outer circumferential face 76 of the rotary plate 4. Thus, a feeding path for trays is constructed by the receiving grooves 5*a* to 5*h*, the guide plates 78 and 79, a plate 80, and so on.

The tray receiving grooves 5*a* to 5*h* are each formed by a substantially half circle portion of a circle having a substantially equal diameter to that of a tray, and in the present embodiment, the receiving grooves 5*a* to 5*h* are formed at up to 8 positions in an angular pitch of 45 degrees.

A pair of rollers 81 for positioning a tray and for allowing smooth rotation of the tray in a given station are mounted for rotation on shafts 82 and located at two positions adjacent a circumferential face of each of the receiving grooves 5*a* to 5*h*. Portions of circumferential faces of the rollers 81 at which they contact with a tray extend slightly from a circumferential face 83 of the receiving groove 5*a* to 5*h* so as to prevent an outer circumferential face of the tray from contacting with the entire inner circumferential face of the receiving groove.

A guide plate 85 is securely mounted on the shafts of the rollers 81 and located in a spaced relationship above the rotary plate 4. The guide plate 85 has arcuate grooves 84*a* to 84*h* formed at positions thereof corresponding to the receiving grooves 5*a* to 5*h* of the rotary plate 4. The arcuate grooves 84*a* to 84*h* are positioned in level with the stand 21 of a tray T as seen in FIG. 12 so that they may prevent a tray therein from falling or jumping therefrom during transportation of the tray.

Referring again to FIG. 9, the plate 80 having a smooth surface and a thickness substantially equal to that of a tray conveyor 87 is securely mounted on a bottom plate 86 in the tray feeding path in order to attain smooth transfer from the conveyor 87 of the station A to the station B.

Reference is now had to FIGS. 13 to 16 which illustrate a drive device for the rotary plate 4. The drive device 90 is installed within a drive box 91 located above the processing stations shown in FIG. 9.

Referring first to FIG. 13, a feed plate 93 is secured to an upper end portion of the shaft 75 secured to the rotary plate 4 by means of a key 94 and has notches 92*a* to 92*h* formed along a periphery thereof in the same pitch with the above mentioned tray receiving grooves 5*a* to 5*h* of the rotary plate 4. A rockable bracket 95 is loosely fitted for rocking motion on a portion of the shaft 75 which extends from the feed plate 93. A rod 96 for rocking the rocking bracket 95 is connected to an end of the bracket 95 relative to the shaft 75 while a hole 99 for receiving a pin 98 which moves into and away from a notch 92*a* to 92*h* is formed at the other end of the bracket 95. A pressing member 100 is supported adjacent an end face of the bracket 95 adjacent the pin 98 by means of a shaft 101 and is contacted with the pin 98 to move the pin 98 into and out of the hole 99. In particular, as shown in FIG. 15, the pin 98 adapted to move into and out of a notch 92*d* of the feed plate 93 is fitted for sliding movement into the hole 99 formed at a portion of the rockable bracket 95, and a compression spring 103 is interposed between a flange portion at the top end of the pin 98 and a shoulder of the bracket 95 to urge the pin 98 out of engagement with the notch 92*d*. A rod 104 connecting to a cam lever which will be hereinafter described is connected by means of a shaft 105 to the pressing member 100 abutted with an upper face of the flange portion 102 of the pin 98. Accordingly, movement of the rod 104 in a direction of an arrow mark 106 or 107 in FIG. 13 will pivot the pressing member 100 around the shaft 101 to press against or retreat from the pin 98.

Figure 16:
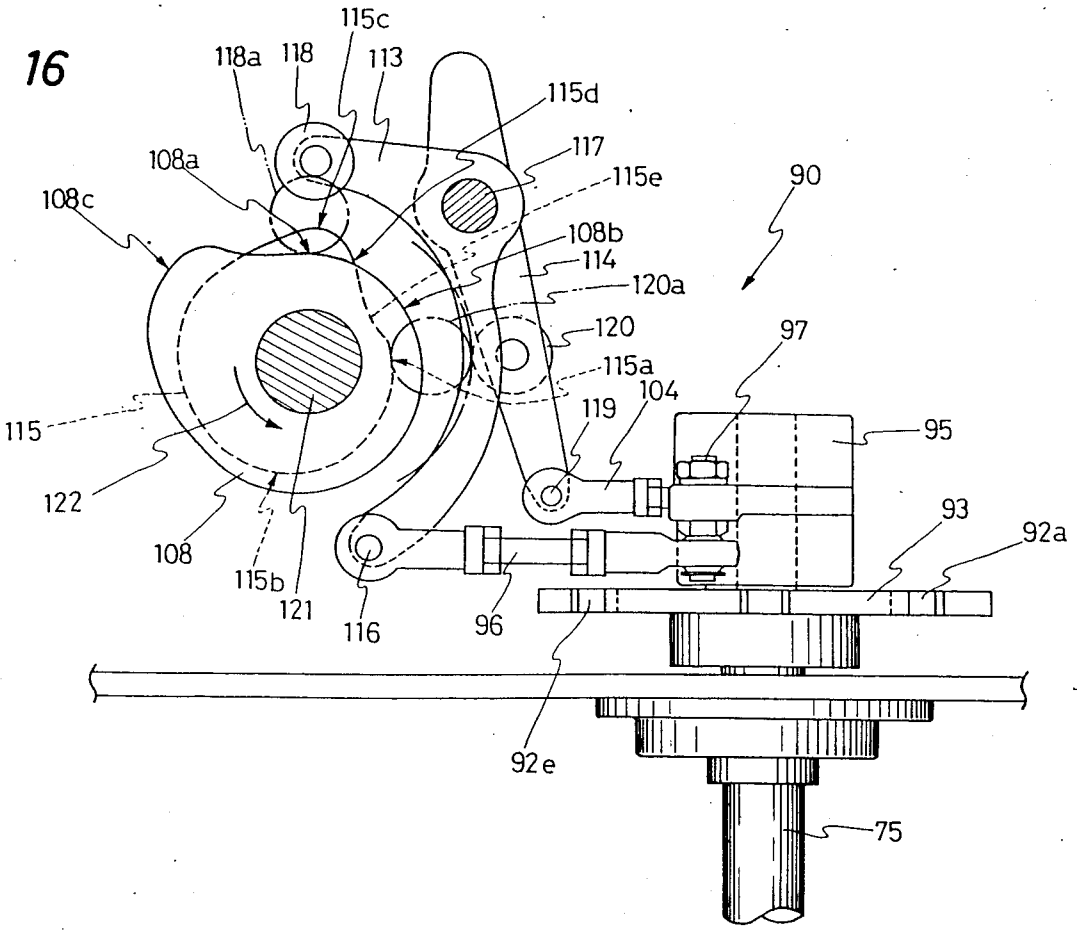
FIG. 16 a side elevational view showing a cam for driving the drive mechanism of FIG. 13.

Thus, in FIG. 13, if the rod 96 is moved a predetermined distance in a direction of a full line arrow mark 109 by a cam plate 108 shown in FIG. 16, the rockable bracket 95 connected to the rod 96 is pivoted a predetermined angle (45 degrees in the embodiment) in the counterclockwise direction around the shaft 75. In particular, as the rockable bracket 95 is pivoted to move the other end 110 thereof from a full line position 110 to a phantom position 110*a*, if the pin 98 is in a full line position wherein it is engaged in a notch 92*d* of the feed plate 93 as seen in FIG. 14, the feed plate 93 will be rotated an angle of 45 degrees in a direction of an arrow mark 111 by the movement of the rockable bracket 95. As a result, the rotary plate 4 at the lower end portion of the shaft 75 secured to the feed plate 93 will be rotated the same angle. After then, if the rod 96 moves in a direction of a broken line arrow mark 112, the rockable bracket 95 will move back from the phantom position 95*a* to the full line position 95. Upon the latter movement, since the pin 98 in the phantom position 98*a* is in a condition retracted from the notch 92*d* of the feed plate 93 as seen in FIG. 15, the returning movement of the rockable bracket 95 to its initial position will not cause rotation of the feed plate 93, allowing the feed plate 93 to remain in its stopped condition.

Referring now to FIG. 16, interrelation between the cam plates 108 and 115 and cam levers 113 and 114 connected to the rods 96 and 104, respectively, is shown. In particular, the cam lever 113 is connected to the rod 96 for driving the rockable bracket 95 by means of a shaft 116 and is supported for pivotal motion on a fixed shaft 117. The cam lever 113 has a cam follower 118 at an end portion thereof and is urged in a direction to contact the cam follower 118 thereof with a cam face of the cam plate 108 by means of a spring not shown. Meanwhile, the cam lever 114 is connected to the rod 104 for controlling the pin 98 by means of a shaft 119 and is supported for pivotal motion on the fixed shaft 117. The cam lever 114 has a cam follower 120 at an intermediate portion thereof between the shafts 119 and 117 and is urged in a direction to contact the cam follower 120 thereof with a cam face of the cam plate 115 by means of a spring not shown. It is to be noted that the cam plates 108 and 115 are secured to a cam shaft 121 and can rotate therewith in a direction of an arrow mark 122.

When the cam follower 118 of the cam lever 113 is in contact with a cam face 108*a*, the rockable bracket 95 is in the phantom position in FIG. 13. Accordingly, upon rotation of the cam plate 108, the cam follower 118 will follow a cam face 108*b* and gradually come to a large diameter portion 108*c* of the cam plate 108 so that the rockable bracket 95 will move from the phantom position 95*a* to the full line position in FIG. 13. When the cam follower 118 moves beyond the larger diameter portion 108*c* to the smaller diameter portion 108*a* of the cam plate 108 in a short period of time, the rockable bracket 95 is pivoted from the full line position 95 to the phantom position 95*a* to rotate the feed plate 93 by one pitch. Meanwhile, the cam lever 114 for controlling the pin 98 is operated in a timed relationship with the movement of the rockable bracket 95. In particular, when the rockable bracket 95 is in the phantom position 95*a* in FIG. 13, the cam follower 120 is in a phantom position wherein it is in contact with a cam face 115*a* of the cam plate 115 while the pin 98 is in a position retracted from a notch 92*d* of the feed plate 93. Upon rotation of the cam plates 108 and 115 from that position, the cam follower 120 will follow a cam face 115*b* to pivot the cam lever 114 in the counterclockwise direction around the shaft 117. In this instance, however, the amount of the pivotal motion of the cam lever 114 is such that it will have no influence on an action of the pin 98 since the pivotal motion is provided only for following the pivotal motion of the rockable bracket 95. When the cam plates 108 and 115 are further rotated so that a larger diameter portion 115*c* of the cam plate 115 comes to the position of the the cam follower 120 and then the cam follower 120 follows a steeply inclined cam face 115*d* to a smaller diameter portion 115*e* of the cam plate 115, the rod 104 will be pulled in a leftward direction in FIG. 16 to pivot the pressing member 100 of FIG. 14 in the clockwise direction around the shaft 101 to press down the pin 98 into engagement with the notch 92*d* of the feed plate 93 against the spring 103. The cam plates 108 and 115 are mounted in different phases from each other such that in the last position the larger diameter portion 108*c* of the other cam 108 is contacted by its cam follower 118. Thus, succeeding rotation of the cam plates 108 and 115 will rotate the feed plate 93 engaged with the pin 98 by one pitch.

Figure 17:
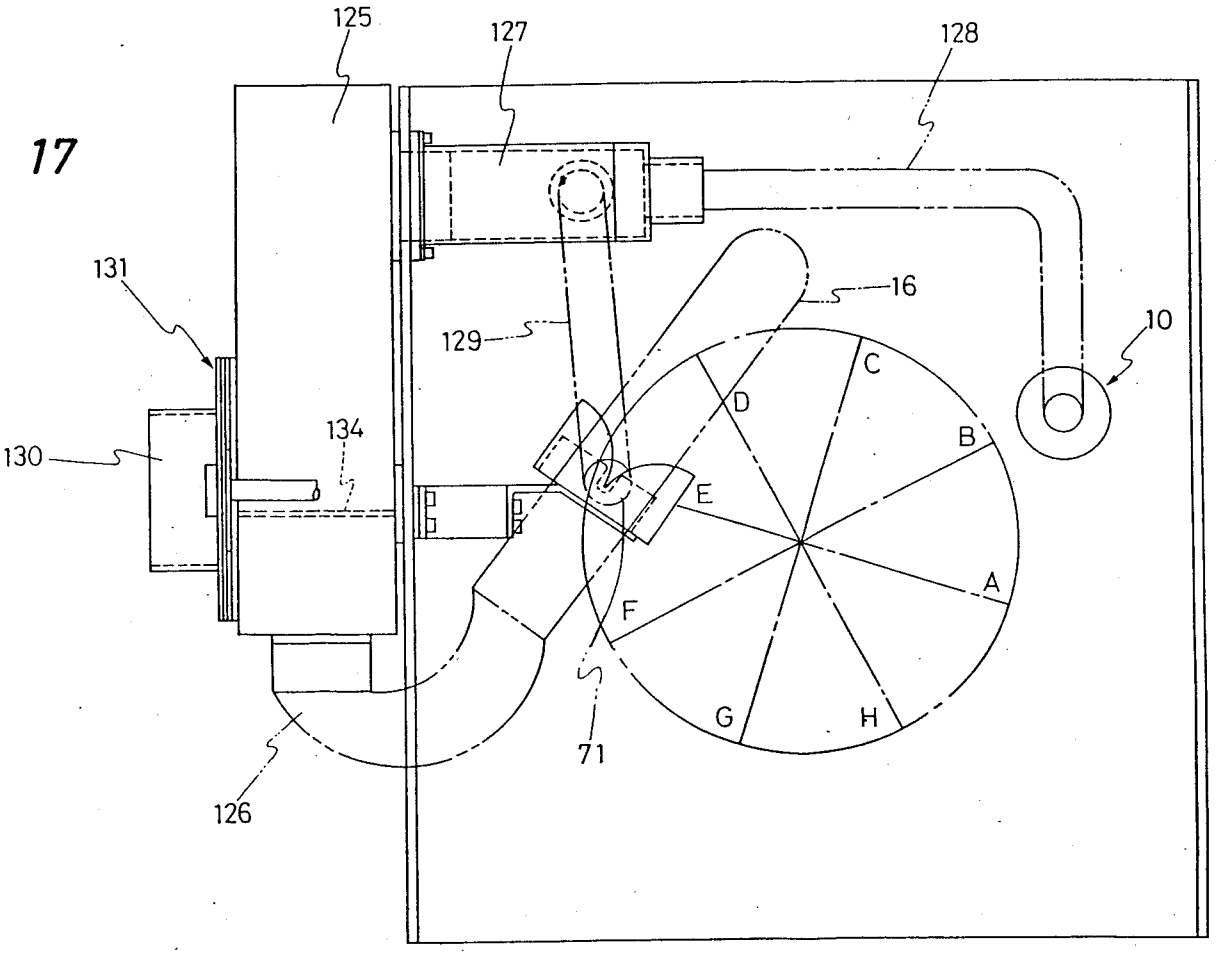
FIG. 17 a view illustrating a general layout of a piping equipment for a suction air flow which is applied to the yard end pick-up apparatus of the present embodiment.
Figure 18:
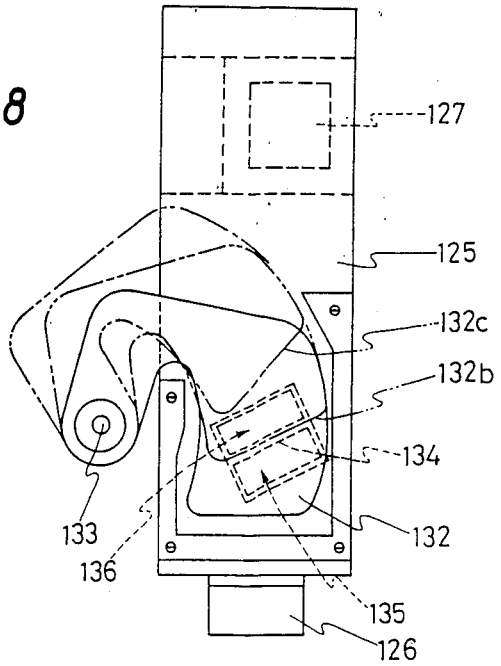
FIG. 18 a side elevational view showing an air shutter of the equipment of FIG. 17.

Reference is now had to FIGS. 17 and 18 which illustrate a piping equipment of pipes for supplying suction air flows to the cutter device 10 in the processing station B of the yarn end finding apparatus, the suction mouth 16 in the station D, the yarn end sucking pipe 71 in the processing station E and so on. In particular, a main duct 125 is located on one side of the frame of the yarn end finding apparatus, and a pipe 126 for the suction mouth 16 and a subduct 127 for the cutter device 10 and for suction and insertion of a yarn end communicate with the main duct 125. A pipe 128 for the cutter device 10 and a yarn end sucking and inserting pipe 129 are connected to and branched from the subduct 127. The main duct 125 has a junction 131 to a main pipe 130 which connects to a blower not shown, and at the junction 132, a movable shutter 132 as shown in FIG. 18 is mounted for pivotal motion around a shaft 133 so that on and off operation of the shutter 132 may turn on and off an action of a suction air flow into the main duct 125 to control the timing of the sucking action to a yarn end in each station. It is to be noted that a partition plate 134 is located in the main duct 125 to partition the pipe 126 from the pipes 128 and 129 to attain an effective action of air. In particular, referring to FIGS. 18 and 19, the shutter 132 can be positioned to three positions, and in a full line position 132, the main duct 125 is disconnected from the blower and hence a sucking force does not operate. In an intermediate position 132*b* of the shutter 132, only an opening 135 for the suction mouth 16 is communicated with the blower while another opening 136 for the other subduct 127 is shut off from the blower. Further, in a position 132*c* in which the shutter 132 is open to its maximum, the opening 136 for the subduct 127 and the opening 135 for the suction mouth 16 are both communicated with the blower, and hence a sucking force will act in all of the pipes 126, 128 and 129.

Figure 19:
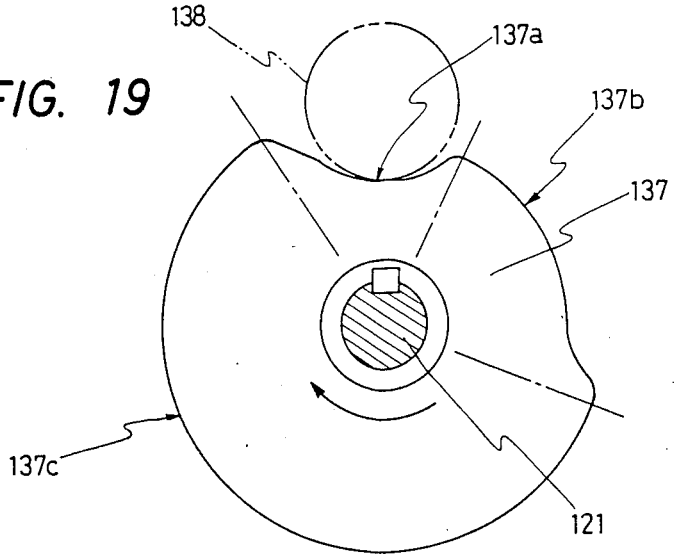
FIG. 19 a side elevational view illustrating a cam for driving the air shutter of FIG. 17.

Such an operation of the shutter 132 can be attained, for example, by a control cam 137 as shown in FIG. 19. In particular, the control cam 137 has three contiguous cam faces 137*a*, 137*b* and 137*c*, and a cam follower 138 is pressed against the cam face 137*a*, 137*b* or 137*c* whereby displacement of the cam follower 138 is transmitted as a rotational motion, via a cam lever not shown which has the cam follower 138 thereon, a connecting rod and so on, to a shaft 133 to which the shutter 132 is secured. Thus, the shutter 132 is controlled to assume the most widely opened phantom position 132*c* by the cam face 137*c* of the control cam 137, the intermediate position by the following cam face 137*b*, and the closed position 132 by the cam face 137*a*. The cam plate 137 is secured to the above mentioned cam shaft 121 as shown in FIG. 16, and hence the shutter 132 will operate in a timed relationship with movement of the tray feeding rotary plate 4. In particular, one pitch feeding of the rotary plate 4 is effected only while the cam follower 138 is contacted with the cam face 137*b*, and in the meantime a sucking force acts only at the suction mouth 16 while the other elements, that is, the cutter 10 and the yarn inserting suction pipe 71 are not acted upon by a sucking force. Then, after rotation of the rotary plate 4 by one pitch and when the cam follower 138 is contacted with the cam face 137*a*, the shutter 132 assumes its closed position, and then after the sucking force of the suction mouth has once been rendered inoperative, the cam follower 138 is contacted with the cam face 137*c* to fully open the shutter 132, allowing the sucking force to act on all suction acting positions.

A yarn end finding operation of the yarn end finding apparatus which includes such mechanisms as described above will be described below.

Referring to FIG. 11, a tray Ta which has been fed in the direction of the arrow mark 3 on the conveyor 87 and on which a spinning bobbin 1*a* is fittedly supported passes in front of a phototube sensor PS and is admitted into a receiving groove 5*a* of the rotary plate 4 which waits in position in the tray admitting station A. As the phototube sensor PS detects the passage of the tray, the rotary plate 4 is rotated one pitch in the direction of the arrow mark 6 after a delay of a fixed time obtained by a timer. In other words, unless the phototube sensor PS detects passage of a tray, the rotary plate is not rotated at all. Accordingly, a tray is always present in each of the receiving grooves 5*a* to 5*e* of the rotary plate 4 in the processing stations A to E, the absence of a tray will never occur in any of the stations A to E. It is to be noted, however, that one of the receiving grooves 5*g* and 5*h* following the delivery station F may sometimes accommodate a tray therein while another one is empty. In particular, in the arrangement of the embodiment, a bobbin with which a yarn end finding has failed is not discharged onto the conveyor 87 from the discharging station F and is thus returned immediately to the admitting station A passing the by-pass stations G and H. In the station A, the bobbin is controlled by the control device so that it may undergo a yarn end finding operation again prior to any other bobbin on the conveyor 87.

A bobbin 1*b* which has come to the processing station B is acted upon the by cutter device 10 as shown in FIGS. 3 to 6 so that a bottom-bunch of a yarn which are wound on a lower end portion of the bobbin are released and cut.

Subsequently, the bobbin is fed from the station B to the station C in which the friction roller 11 is contacted with the tray Tc to rotate the bobbin 1*c* in the yarn winding direction so that the released yarn which extends between the bobbin 1*c* and the cutter 10 in the preceding station B is wound onto a surface of a yarn layer on the bobbin 1*c*. It is to be noted that winding of the yarn end in this instance does not mean that the yarn end is gripped and wound positively around a periphery of a bobbin but means that a yarn having a free end is only passively and lightly wound around a bobbin by rotation of the bobbin and hence the yarn end is not at all wound hard enough to make picking up of the yarn end in a next station difficult.

After then, the bobbin comes to the station D, and in the station D, the bobbin 1*d* is rotated in a direction to release the yarn therefrom by engagement of the friction roller 17 with the tray Td, and the yarn end is released by and sucked into the suction mouth 16 located adjacent a surface of the yarn layer on the bobbin 1*d*. The yarn thus picked up is moved along the slit 62 as shown in FIG. 7 to produce an extension of the yarn between the station D and the slit 62.

Subsequently, the bobbin is fed from the station D to the station E in which the picked up yarn Y3 is guided into the cutter device 60 by the guide plates 64 as seen in FIG. 7 and operates a yarn detecting feeler. At this instant, since a suction air flow is produced by the suction pipe 71 located below the tray Te in the station E, the yarn end cut by the cutter 60 is sucked and inserted into the center hole 18 of the bobbin, thereby completing the process of yarn end finding.

It is to be noted that when a yarn end is to be inserted, it is necessary for the opening at the top of the bobbin center hole 18 to be positioned just below the yarn cutting position, that is, the cutter 60, in order to prevent failure in insertion, and in the case of the present embodiment, the guide wire 67 for controlling the position of the upper end of a bobbin is provided. However, it is otherwise possible to provide a guide member which has a truncated conical cap having a self-aligning action fitted on the head 66 of a take-up tube and has a yarn passing slit formed to extend between a center hole of the cap and an outer periphery thereof. In this instance, it is necessary to mount the conical guide member for movement in a vertical direction.

Accordingly, a bobbin which has come to the station F is in a condition wherein an end string of a yarn of a fixed length is suspended from the top into the center hole of the bobbin, and it is discharged onto the transportation path 7 for supply to a winder as a bobbin which remains fitted uprightly on a tray.

It is to be noted that while it has been already described that in the present embodiment a bobbin with which a yarn end finding has failed is not discharged from the station F and is thus returned to the station A passing the by-pass stations G and H, if failure in a yarn end finding is repeated for a particular bobbin, only movement of the movable guide 27 in FIG. 2 provided in the station F to the position 27*a* when absence of a yarn is detected by the yarn detecting device in the station E will result in repetitive circulation through the stations A to H of the particular bobbin from which a yarn end cannot be found and will thus result in inefficiency.

Therefore, in the present embodiment, means is provided for preventing operation of the movable guide 27 in order to discharge a particular bobbin onto the transportation path 7 if the number of failures in yarn end finding for the particular bobbin reaches a prescribefd number. In other words, a by-pass circuit is provided which can effect pursuit of a bobbin with which yarn end finding has failed.

Figure 20:
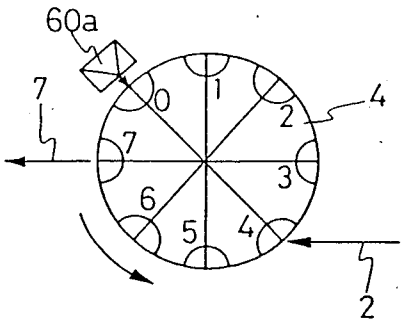
FIGS. 20 and 21 are diagrammatic representations for illustration of a by-passing operation for a bobbin with which picking up of a yarn end has failed, FIG. 20 being a view illustrating an example of application of a port of a rotary plate, and FIG. 21 being a view illustrating the rotary plate which has rotated one pitch from the position of FIG. 20.
Figure 22:
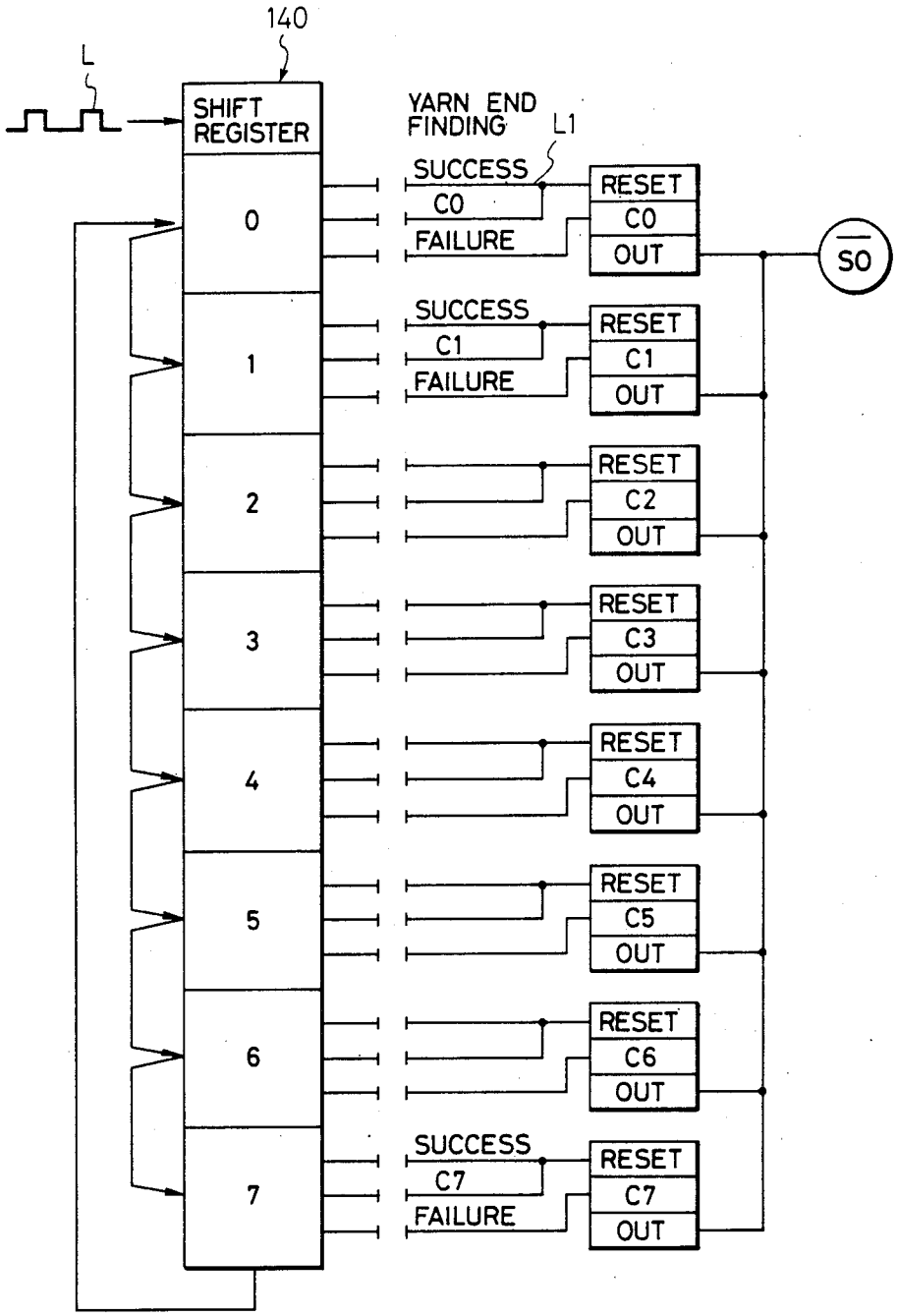
FIG. 22 is a circuit diagram of a circuit for attaining the by-passing operation of FIGS. 20 and 21.

Referring now to FIG. 20, the 8 equally sectioned bobbin receiving grooves are indicated at Port 0 to Port 7. Now, it is assumed that a bobbin receiving groove which is in position in the station E and in which a yarn detecting feeler 60*a* is provided is designated Port 0 and successive bobbin receiving grooves therefrom in a direction opposite to the rotational direction of the rotary plate are designated Port 1 to Port 7 in order. Referring to FIG. 22, 8 cells or registers having numerical indications 0 to 7 and constituting a shift register 140 correspond to Port 0 to Port 7, respectively. Here, by-passing is allowed only twice for a single bobbin and hence a bobbin with which yarn end finding has failed three times is determined to be discharged onto the transportation path 7. To this end, 3 is set to counters C0 to C7 corresponding to the shift register cells 0 to 7. Now, if it is assumed that yarn end finding has failed with a bobbin in a condition of FIG. 20, since the shift register 140 starts from 0, the contents of the counter C0 become 0 by logical AND of the register 0 with a finding failure signal. Simultaneously, in response to the finding failure signal, a solenoid S0 for the movable guide 27 is energized to cause the bobbin to by-pass.

Figure 21:
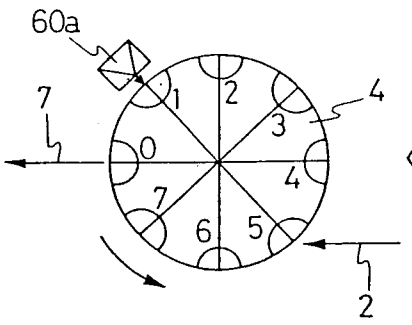

Then, if the rotary plate 4 advances one pitch as seen in FIG. 21, then the shift register 140 advances to the register 1 in response to a rotary plate rotating signal L, and here if yarn end finding fails, the contents of the counter C1 become 1. Accordingly, also in this case, the solenoid S0 is energized to cause the specific bobbin to by-pass in a similar manner.

If the rotary plate 4 completes one rotation to bring the port 0 again to the finding failure detecting station, the shift register 140 returns to the register 0, and if failure in finding occurs again, the contents of the counter C0 become 2 by addition of 1 to the former contents 1. Also in this case, the solenoid S0 is energized so that the bobbin with which yarn end finding has failed for the second time is caused to by-pass again.

If the contents of the counter C0 become 3 in this manner, an output of the counter C0 is used as a solenoid energization inhibiting signal so that the bobbin is now discharged onto the transportation path 7. After then, the counter C0 is reset.

However, if yarn end finding is successfully done for the second or third time, the counter corresponding to the port is reset in accordance with logical AND of the register of the shift register with a finding success signal. At the same time, the bobbin from which a yarn end has been successfully found is discharged onto the transportation path 7 since the solenoid S0 is not energized.

In this manner, a bobbin can circulate along the rotary plate and undergo a yarn end finding operation until the number of failures in finding of a yarn end reaches a present number.

It is to be noted that only if a regular yarn end finding operation is carried out again for a bobbin with which yarn end finding has failed, there is a high possibility that yarn end finding fails again. To this end, it is effective, for example, to provide a modifying device in the station G or H for by-passing such as a serrated searcher which is located for contact with a surface of a yarn layer on a bobbin for searching an end of a yarn or an elastic plate member which is struck against a surface of a yarn layer on a bobbin to facilitate the yarn end from being separated from the yarn layer. In this instance, a surface of a yarn layer on a normal bobbin is not damaged since a bobbin from which an end of a yarn has been successfully found for the first time is not subject to operation of the modifying device.

As apparent from the foregoing description, according to the present invention, a bobbin can undergo a yarn end finding operation while it is held fitted uprightly on a tray without being pulled off the tray. Accordingly, a yarn end can be found at a high speed twice or three times to that in a conventional apparatus.

What is claimed is:

1. An apparatus for finding an end of a yarn on a spinning bobbin fitted uprightly on a tray, comprising:

a cutter mechanism for releasing and cutting a yarn end on the bobbin, a yarn end pick-up mechanism located adjacent said cutter mechanism for picking up an end of the cut yarn from a layer of the yarn, a yarn end inserting mechanism located adjacent said yarn end pick-up mechanism for cutting the yarn end picked up from the yarn layer to a particular length and for inserting the yarn into a center hole of the bobbin, and delivery means for delivering said spinning bobbin fitted uprightly on said tray in sequence to each of said cutter mechanism, said yarn end pick-up mechanism and said yarn end inserting mechanism, whereby the end of the yarn is found while the bobbin is held integrally on a tray.

2. An apparatus for finding an end of a yarn wound on a spinning bobbin fitted uprightly on a tray, comprising:

a cutter mechanism for releasing and cutting a yarn end on the bobbin, a yarn end pick-up mechanism located adjacent said cutter mechanism for picking up an end of the cut yarn from a layer of the yarn, and a yarn end inserting mechanism located adjacent said yarn end pick-up mechanism for cutting the yarn end picked up from the yarn layer to a predetermined length and for inserting the yarn into a center hole of the bobbin, wherein said cutter mechanism comprises:

a suction case having an outer circumferential face, a rotary cutter having an outer circumferential face and mounted for rotation within the suction case, a fixed blade positioned to contact at least a portion of the outer circumferential face of the rotary cutter, a suction pipe in communication with the suction case for producing a suction air flow within the rotary cutter, and a motor for driving the rotary cutter with respect to the fixed blade.

3. The apparatus as claimed in claim 2, wherein said cutter mechanism further includes a friction roller for rotating the tray upon which the bobbin is fitted in a direction opposite to the winding direction of the yarn on the bobbin.

4. The apparatus as claimed in claim 2, wherein the outer circumferential face of the suction case includes a yarn end sucking opening and a slot formed in spaced relationship to said yarn end sucking opening, said slot being positioned for permitting an edge of the fixed blade to contact the outer circumferential face of the rotary cutter.

5. The apparatus as claimed in claim 4, wherein said rotary cutter further includes a plurality of yarn end passing holes formed in spaced relationship in the outer circumferential face of said rotary cutter, at least one of said yarn end passing holes having a circumferential edge, said circumferential edge of said yarn end passing hole and said fixed blade being positioned to form a cutter capable of cutting a yarn end disposed therebetween.

6. The apparatus as claimed in claim 5 further comprising a movable bracket upon which said cutter mechanism may be placed, said movable bracket being operable to adjust the relative position of the yarn end sucking opening of the suction case and the bobbin.

7. The apparatus as claimed in claim 1, wherein said yarn end pick-up mechanism comprises a suction pipe having an opening in the form of a first slit extending substantially longitudinally along a portion of the length of the pipe, said first slit having a length substantially equal to the length of the yarn layer wound on the bobbin.

8. The apparatus as claimed in claim 7, wherein the yarn end inserting mechanism comprises a yarn detecting and cutting device for detecting the presence of yarn picked up from the bobbin by said yarn end pick-up mechanism and for cutting the yarn to a predetermined length, a substantially horizontal extension of said suction pipe, said extension having an opening in the form of a second slit formed contiguously to the first slit of the yarn end pick-up mechanism, said extension and said second slit extending to a position substantially above the yarn detecting and cutting device, and a yarn end sucking mechanism for sucking the yarn end cut by said yarn detecting and cutting device into the center hole of a bobbin.

9. The apparatus as claimed in claim 8, wherein said suction pipe further includes an auxiliary air path which is disposed substantially adjacent to and intermediate the first slit and the second slit, said auxiliary air path having an air injecting hole formed therein through which compressed air may be injected into said auxiliary air path in a direction toward said second slit.

10. The apparatus as claimed in claim 8, wherein said yarn end sucking mechanism comprises a second suction pipe located below the yarn detecting and cutting device for causing a suction air flow in the center hole of a bobbin positioned between said second suction pipe and said yarn detecting and cutting device so that a yarn end cut by said yarn detecting and cutting device is sucked into the center hole of the bobbin.

11. The apparatus as claimed in claim 1, wherein said means for delivering said spinning bobbin further comprises a rotary plate which is secured to a vertically extending first shaft said rotary plate having a plurality of tray receiving grooves formed therein at a predetermined pitch along the periphery thereof, said cutter mechanism, said yarn end pick-up mechanism and said yarn end inserting mechanism being disposed about the periphery of said rotary plate.

12. An apparatus for finding an end of a yarn on a spinning bobbin fitted uprightly on a tray, comprising:

a cutter mechanism for releasing and cutting a yarn end on the bobbin;

a yarn end pick-up mechanism located adjacent said cutter mechanism for picking up an end of the cut yarn from a layer of the yarn, a yarn end inserting mechanism located adjacent said yarn end pick-up mechanism for cutting the yarn end picked up from the yarn layer to a predetermined length and for inserting the yarn end into a center hole of the bobbin, whereby the end of the yarn is found while the bobbin is held integrally on a tray, a rotary plate which is secured to a vertically extending first shaft, said rotary plate having a plurality of tray receiving grooves formed therein at a predetermined pitch along the outer periphery thereof, said cutter mechanism, said yarn end pick-up mechanism and said yarn end inserting mechanism being disposed about the outer periphery of said rotary plate, at least one guide plate having a guide face concentric with and spaced apart from the outer periphery of the rotary plate , said guide plate and said tray receiving grooves of said rotary plate forming a transporting path for said trays.

13. The apparatus as claimed in claim 12, wherein the tray receiving grooves of the rotary plate are substantially semicircular in shape, said apparatus further comprising:

a pair of rollers mounted for rotation on the rotary plate at positions adjacent each of the tray receiving grooves, and a guide plate located in a spaced relationship above the rotary plate, said guide plate having a plurality of arcuate grooves formed therein at positions corresponding to the positions of the tray receiving grooves of the rotary plate.

14. An apparatus for finding an end of a yarn on a spinning bobbin fitted uprightly on a tray, comprising:

a cutter mechanism for releasing and cutting a yarn end on the bobbin, a yarn end pick-up mechanism located adjacent said cutter mechanism for picking up an end of the cut yarn from a layer of the yarn, a yarn end inserting mechanism located adjacent said yarn end pick-up mechanism for cutting the yarn end picked up from the yarn layer to a predetermined length and for inserting the yarn end into a center hole of the bobbin, whereby the end of the yarn is found while the bobbin is held integrally on a tray, a rotary plate which is secured to a vertically extending first shaft, said rotary plate having a plurality of tray receiving grooves formed therein at predetermined pitch along the outer periphery thereof, and a bobbin admitting station and a bobbin discharging station are further provided around the rotary plate, and a drive device for the rotary plate, said drive device comprising:

a feed plate secured to an upper end portion of the first shaft secured to the rotary plate, said feed plate having notches formed along the periphery thereof in the same pitch as the tray receiving grooves of the rotary plate, a rocking bracket fitted for rocking motion on the first shaft, a first rod for rocking the rocking bracket connected to a first end of the rocking bracket, and a pin fitted on a hole formed at a second end of the rocking bracket, said pin being movable relative to the notches of the feed plate.

15. The apparatus as claimed in claim 14, wherein said pin may be moved by a pressing member disposed adjacent an end of the rocking bracket , said pressing member being connected with a second rod capable of moving the pressing member.

16. The apparatus as claimed in claim 15, wherein at least one of said first and second rods is connected with a cam lever and is moved by means of a cam plate which is secured to a cam shaft and rotated by the cam shaft, a cam follower being supported on said cam lever and being urged in a direction to contact with a cam face of the cam plate, so that rotation of the cam plate may rotate the feed plate by one pitch.

17. An apparatus for readying an end of yarn on a spinning bobbin fitted uprightly on a tray, said apparatus being disposed adjacent a bobbin transportation path along which said spinning bobbins are transported between a winder and a spinning frame, said bobbin transportation path having a first portion associated with said spinning frame and a second portion associated with said winder, said apparatus comprising:

a first transportation path for finding an end of a yarn of the spinning bobbin, said first transportation path including a bobbin admitting station disposed adjacent the first portion of said bobbin transportation path associated with said spinning frame and a bobbin discharging station disposed adjacent the second portion of said bobbin transportation path associated with said winder, and along which one or more yarn end finding mechanisms are arranged at substantially stationary locations, delivery means for delivering the spinning bobbin to the yarn end finding mechanisms and a second transportation path for feeding back a bobbin from which a yarn end can not be found, disposed contiguously to the first transportation path between the bobbin discharging station and bobbin admitting station, whereby a yarn end finding failed bobbin is returned to the yarn end finding mechanisms through the second transportation path.

* * * * *